United States Patent [19]

Focke et al.

[11] Patent Number: 4,612,756

[45] Date of Patent: Sep. 23, 1986

[54] APPARATUS FOR INTRODUCING CIGARETTE GROUPS INTO CIGARETTE PACKS

[75] Inventors: Heinz Focke; Horst Langer, both of Verden, Fed. Rep. of Germany

[73] Assignee: Focke & Co., Fed. Rep. of Germany

[21] Appl. No.: 421,617

[22] Filed: Sep. 22, 1982

[30] Foreign Application Priority Data

Dec. 19, 1981 [DE] Fed. Rep. of Germany ..... 3150447

[51] Int. Cl.[4] ..... B65B 47/00

[52] U.S. Cl. ..... 53/579; 53/234

[58] Field of Search ..... 53/148, 220, 234, 236, 53/579, 150, 156, 223–225, 228, 230, 231, 232–234, 534, 535

[56] References Cited

U.S. PATENT DOCUMENTS 2,653,430 9/1953 Vogt ..... 53/224 X
3,402,528 9/1968 Schmermund ..... 53/223 X
4,258,528 3/1981 Focke ..... 53/230 X

FOREIGN PATENT DOCUMENTS 1030347 5/1966 United Kingdom ..... 53/148

*Primary Examiner*—Robert L. Spruill
*Assistant Examiner*—Steven P. Weihrouch
*Attorney, Agent, or Firm*—Sughrue, Mion, Zinn, Macpeak, and Seas

[57] ABSTRACT

In the production of cigarette packs, especially as hinge-lid or flip top packs, the introduction of a group of cigarettes, in the form of a cigarette block, into the partially folded pack is accomplished by feeding the cigarette block in the radial direction to a folding turret for the pack, the cigarette block being received in a block pocket during a transport stage. To prevent relative displacements in this stage, the cigarette block is fixed, during transport in the block pocket, by clamping.

24 Claims, 13 Drawing Figures

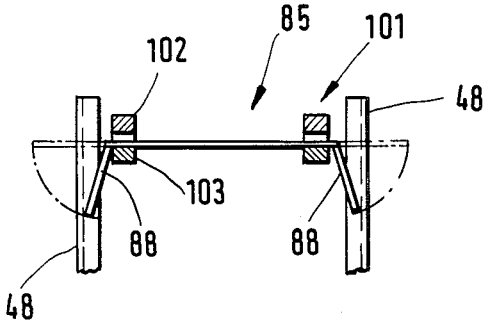
Fig. 10
Fig. 12
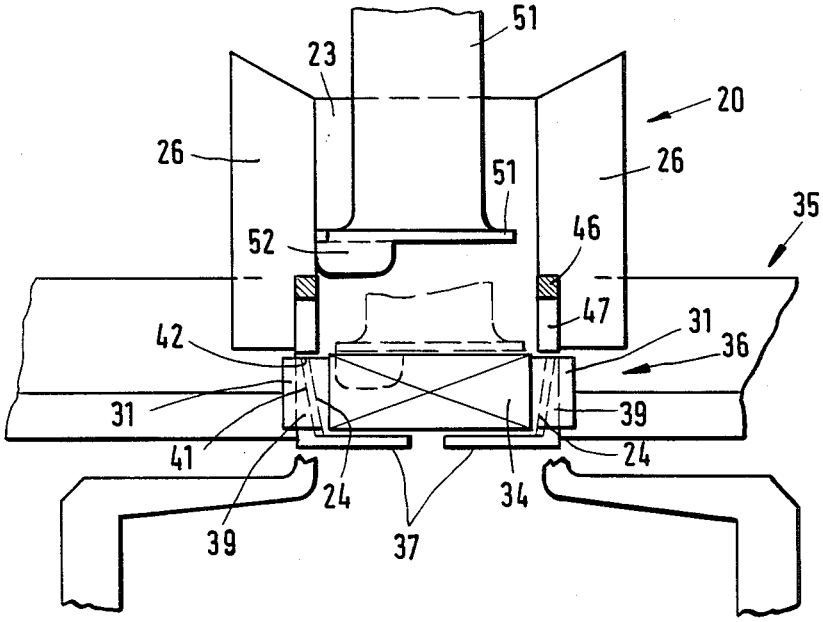

APPARATUS FOR INTRODUCING CIGARETTE GROUPS INTO CIGARETTE PACKS

The invention relates to an apparatus for feeding pack contents, especially cigarette groups, to a pack (cigarette pack) and for introducing them into this, the pack content being received, at least during a transport portion, before introduction into the pack in a holder (pocket) movable to and fro.

The invention applies to packing machines for making packs with a pack content in pieces, especially with an individual article for each pack.

The preferred field of application of the invention is the production of cigarette packs, and of these specifically the production of so-called hinge-lid packs.

The invention is also used primarily on those packaging machines in which the pack or the blank for making this are already partially folded before the pack content is supplied and introduced. After the pack content has been pushed in, further folds completing the pack are carried out.

The preferred example for application of the invention is described in commonly assigned U.S. Pat. No. 4,084,393. This prior publication deals with the production and filling of hinge-lid packs for cigarettes. Here, a blank made of paper or thin cardboard for producing the pack is introduced into a pocket of a folding turret revolving about a vertical axis and is partially folded, before the pack content (the cigarette group wrapped in a tin foil blank) is pushed in a radial direction in relation to the folding turret into the pocket or into the pack located therein.

SUMMARY OF THE INVENTION

The invention is concerned with improving the preparation of the cigarette group during transport to the partially folded pack, in such a way that at the high working speeds, on the one hand, the cigarettes are handled carefully, but, on the other hand, the inner tin foil wrapper is folded round the pack content exactly. Since the pack content is exposed to considerable accelerations and decelerations during the time when it is supplied and introduced, according to the invention care will be taken to ensure that the pack is fixed exactly during this transport directed in a radial direction relative to the folding turret. Finally, the invention deals with supplying a separate collar blank with the pack content to the folding turret.

To achieve the object stated above, the apparatus is characterized in that the cigarette group is fixed to or in the holder (pocket) at least during transport.

As in the apparatus according to U.S. Pat. No. 4,084,393, the apparatus according to the invention is equipped with a pocket movable to and fro, in which the pack content is received during the last stage of transport to the folding turret. The cigarette group or the group wrapped in a (tin foil) wrapping blank (cigarette block) is retained in this pocket, preferably by pressing the cigarette block and thereby clamping it against a wall of the pocket, preferably against its top wall. Pressing is caused, in turn, by the relative movement of a (another) wall of the pocket, especially as a result of the upward movement of a partial region of the bottom wall of the pocket. These relative positions are maintained during the transport of the cigarette block in the pocket.

Furthermore, in the invention, care is taken to ensure perfect feeding of a collar blank. This is fed conversely to the transport direction of the cigarette block or the pocket of the latter and is transported further, above the pocket, synchronously with it. During the time when the cigarette block is pushed directly into the pack within the turret pocket of the folding turret, the collar blank is lowered onto the cigarette block and positioned on the latter.

Measures are likewise taken, according to the invention, for the exact retention of the partially folded pack in the turret pocket open radially outwards. These measures ensure that the pack is pressed against a pocket bottom. Moreover, blank parts folded into a vertical position are brought into a position opening in the form of a funnel, so that it is guaranteed that the cigarette block will be pushed in faultlessly. There are also measures which fix the pushed-in cigarette block in the pack and, at the same time, compensate possible differences in position.

BRIEF DESCRIPTION OF THE DRAWINGS

An exemplary embodiment of the invention is explained in more detail below with reference to the drawings in which:

FIG. 10 shows a detail corresponding to a section in the plane X—X of FIG. 4, FIG. 12 shows, in a vertical section or in a radial view, a detail in the region of the folding turret.

DETAILED DESCRIPTION OF THE PREFERRED EMBODIMENT

Figure 1:
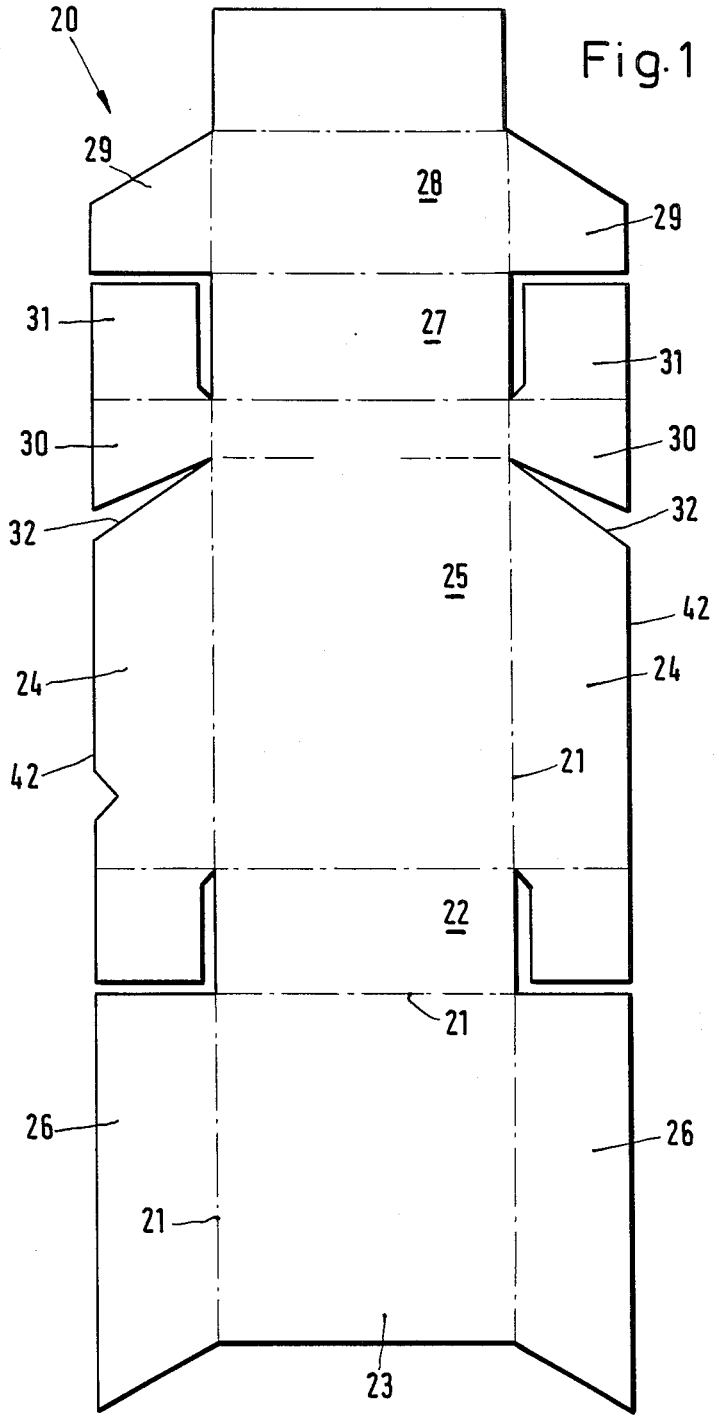
FIG. 1 shows a spread-out blank of a (cigarette) pack of the "hinge-lid" type.

The apparatus described is especially suitable as a part unit of a cigarette packaging machine according to U.S. Pat. No. 4,084,393. The preferred field of application is the production of hinge-lid or flip top packs for which a blank 20 is shown in FIG. 1 for the sake of better understanding. This is divided by longitudinally and transversely directed folding lines 21 into individual sheet-like regions to form a bottom wall 22, a front wall 23, side tabs 24, a rear wall 25 and side tabs 26. In the finished pack, the side tabs 24 and 26 are folded over one another to form side walls and joined to one another by gluing. To form a hinge lid there are a lid end wall 27, a lid front wall 28, outer gussets 29 adjoining the latter, inner gussets 30 and lid corner tabs 31. The inner gussets and lid corner tabs extend as a prolongation of the side tabs 24, but are severed from these by means of a wedge-shaped incision which forms a sloping end edge 32 on the side tabs 24. The inner gussets 30, together with the adjoining lid corner tabs 31 are connected to the rear wall 25.

An inner tin foil blank wraps a group of cigarettes to form a cigarette block 34 which will be introduced into the partially folded pack formed from the blank 20.

The preliminary or partial folding of the blank 20 for receiving the cigarette block 34 is preferably carried out in the way described in U.S. Pat. No. 4,084,393. According to this, the blank 20 is introduced into a folding turret 35 which is designed as a flat plate and which is provided along its periphery with box or pack pockets 36, each for receiving a blank 20 or a pack. The pack pockets 36 are limited by a bottom 37 and by a radially inner wall 38 which is formed by a downward-pointing leg of an angular profile. Radially extending pocket side walls 39 adjoin laterally the pocket bottom 37, which is divided centrally. On the top and radially outer sides the pack pockets 36 are open.

In the region of a feed station 40 the blank 20 is prefolded until an angular intermediate folding position is assumed, seen in a radial direction. The rear wall 25, the lid end wall 27 and the lid front wall 28 extend in a horizontal plane, the rear wall 25 resting on the appropriately dimensioned pocket bottom 37. The side tabs 24 connected to the rear wall 25 are folded into a vertically oblique position, resting inclined against the inner sides of the pocket side walls 39 on bearing faces 41, in such a way that the side tab edges point upwards and are spaced from a cigarette block 34 introduced into the pack pocket 36.

The inner gussets 30 and the lid corner tabs 31, which follow the side tabs 24 on the radially outer side, are located in a substantially vertical position. However, seen in a plan view, the lid corner tabs 31 adjoining the inner gussets 30 are folded outwards in the form of a funnel, to make it easier to introduce the cigarette block 34.

A vertical leg of the blank 20 folded at an angle is formed by the bottom wall 22 and the adjoining front wall 23. The side tabs 26 belonging to the latter are likewise directed vertically and extend in the plane of the front wall 23.

Figure 2:
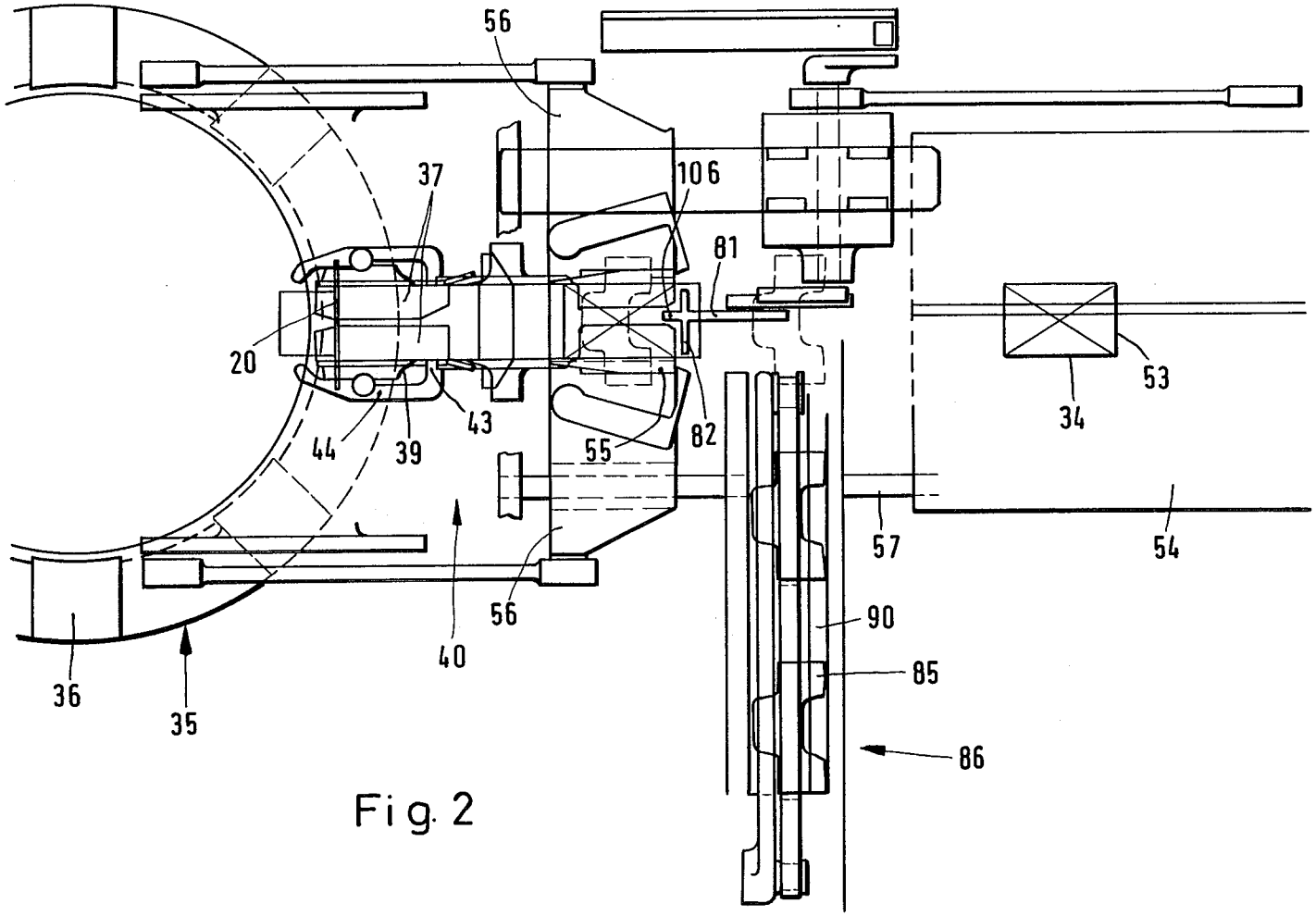
FIG. 2 shows the apparatus according to the invention in a simplified plan view.
Figure 3:
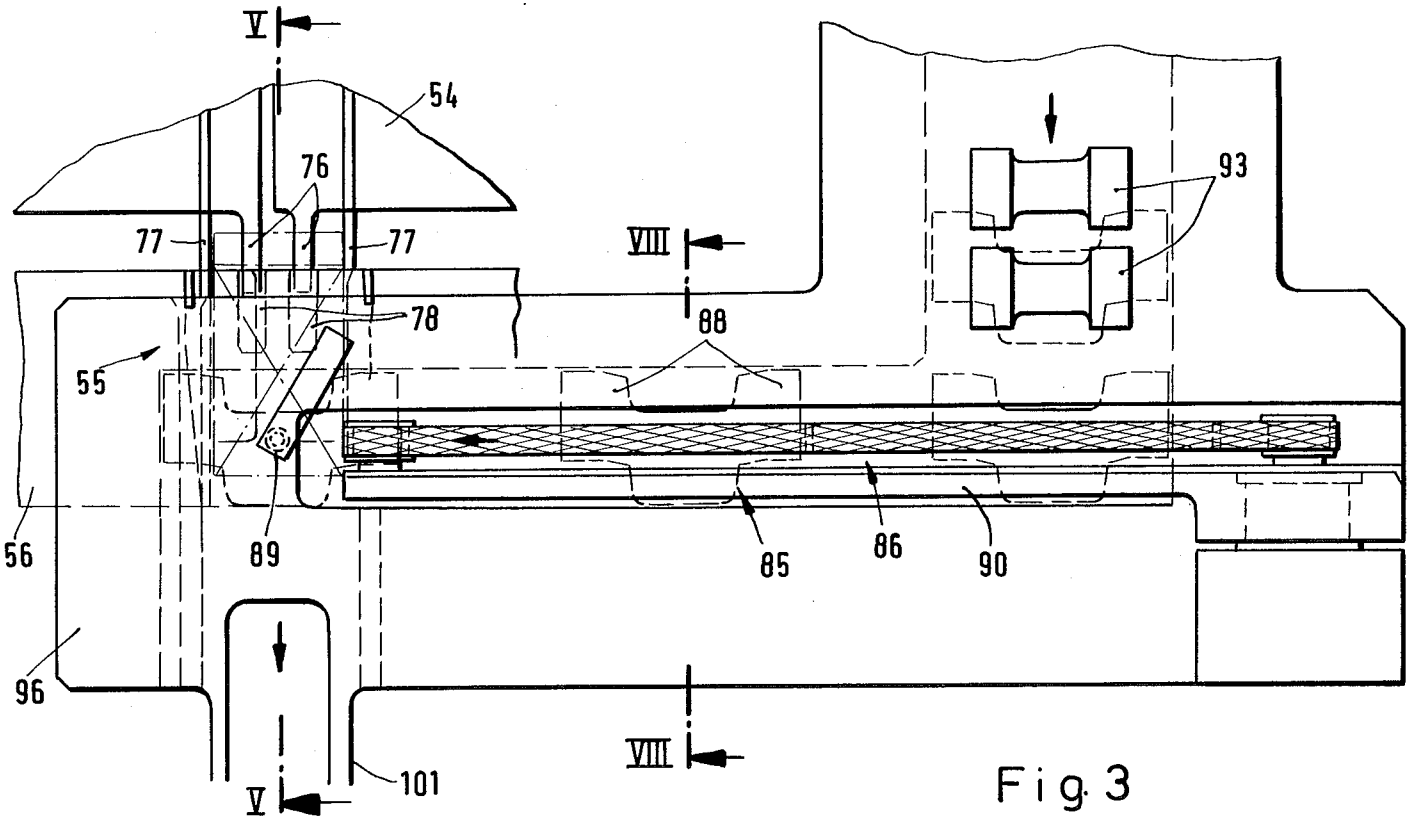
FIG. 3 shows, in a plan view, a detail of the apparatus according to FIG. 2, namely the region of supply of collar blanks.
Figure 4:
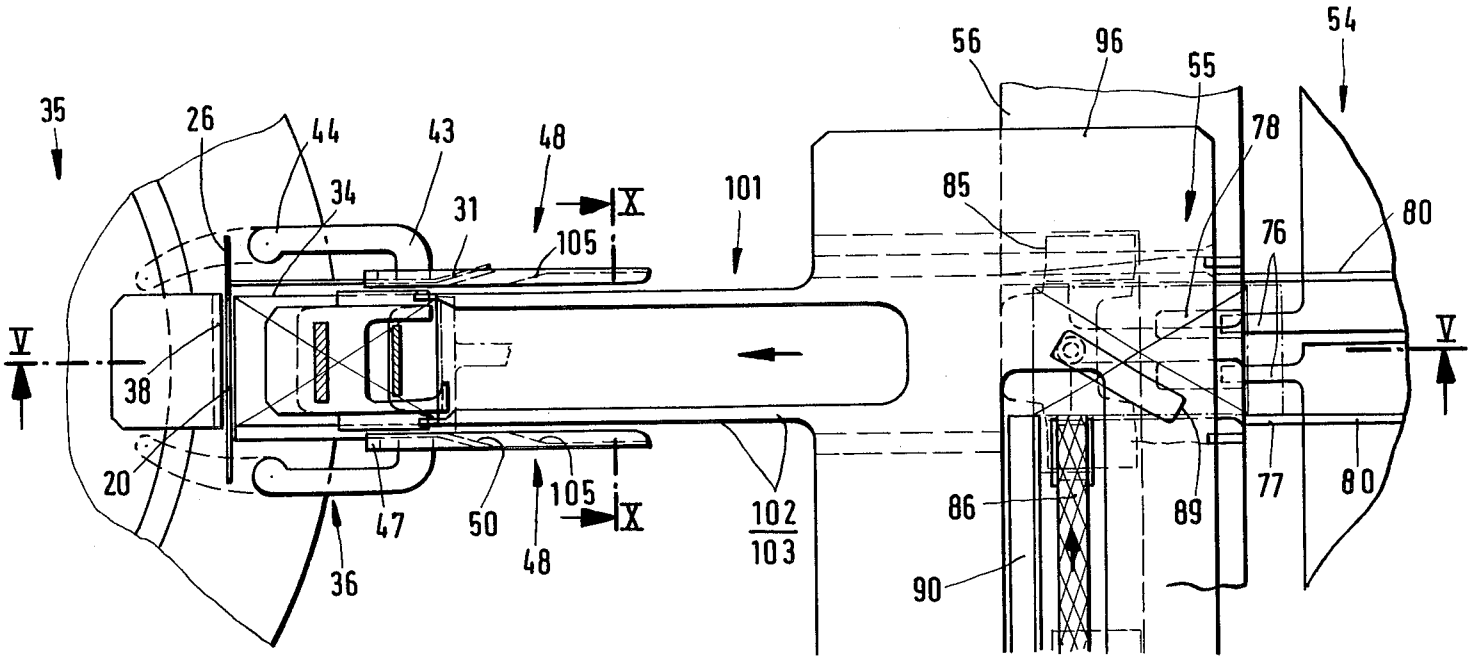
FIG. 4 shows, likewise in a plan view, a region of the apparatus adjoining this, namely a region facing a folding turret, for the transport of a cigarette block with a collar blank.

During the radially directed introduction of the cigarette block 34 into the partially folded pack blank 20, the latter is held in the pocket 36 by lateral retaining jaws 43 assigned to each pocket to prevent undesirable displacements of the blank in a radial direction. These retaining jaws are located at the ends of a two-armed pivoting lever 44 and can be brought into the position shown especially in FIGS. 2 and 5, whereat the jaws 43 rest against the vertical inner gussets 30 with sloping supporting edges 45 of the jaws resting against the likewise sloping end edges 32 of the side tabs 24. This resting contact is enabled by inclination of the side tabs. Displacement of the blank 20 in a radial direction within the pack pocket 36 is prevented as a result.

Undesirable upward movements are forestalled by holding-down devices 46 which are lowered from above onto the pack pocket 36 or the blank 20, in such a way that a downward-pointing pressure leg 47 rests on the side tab 24, namely the upper side-tab edge 42.

The funnel-shaped position of the lid corner tabs 31 is ensured by guide walls 48 which can be moved into an appropriate position and which, in the present case, each form a common member with the holding-down device 46. The guide walls 48 are attached respectively to lateral pivoting levers 49 and are designed so that the lid corner tab 31 comes to rest against appropriately located supporting faces 50 extending obliquely to the direction of transport of the cigarette block 34. As a result of movement of pivoting levers 49, the guide wall 48 is brought into position, and because of the wedge-shaped design of the guide wall 48 in the region of the supporting face 50 the lid corner tab 31 is folded into the oblique position relative to the inner gusset 30 retained by the retaining jaw 43.

Finally, care is taken to ensure, in the region of the feed station 40, that the cigarette block 34 introduced into the blank 20 is positioned exactly. For this purpose, a ram plate 51 can be advanced from above, and this places itself on the topside of the cigarette block 34 and grasps by means of a tab 52 a radially outer end face 53 of the cigarette block.

In conformity with the apparatus according to U.S. Pat. No. 4,084,393, the cigarette blocks 34 are fed to the folding turret 35 in a radial direction relative to the latter. During the final stage of transport, the tin foil blank wrapping a group of cigarettes is ready-folded in the region of the end face 53 at the rear in the direction of transport.

The cigarette blocks 34 are supplied to a block pocket 55 and introduced into this in succession on a pack track 54 by means of a chain conveyor. The block pocket 55 takes over the transport of the cigarette block 34 into the vicinity of the folding turret 35. The block pocket 55 is reciprocable for this purpose. The block pocket 55 is formed on a plate-shaped cross member 56 extending transversely to the direction of movement. This, in turn, is slidably mounted on lateral guide rods 57.

The block pocket 55 consists of a bottom 58, vertical side walls 59 and a top wall 60. The latter is formed by two horizontal legs 61, 62, between which is formed a slit 63 extending somewhat off-center. The rear side for introducing the cigarette block 34 and the front side for pushing it out are open.

The bottom 58 of the block pocket 55 consists of two parts, namely a fixed part 64 located at the front in the direction of transport and a lifting part 65 forming approximately the rearward half of the bottom 58. After a cigarette block 34 has been introduced, this lifting part can be lifted into the block pocket 55, in such a way that the cigarette block 34 is also lifted and thereby fixed to the top wall 60 of the block pocket 55 by pressing. As a result, during transport by the block pocket 55, the cigarette block 34 is fixed in the pocket against relative movements.

The movable lifting part 65 is located on a two-armed pressure lever 66. This pressure lever 66 pivotable about a bearing 67 can be supported by its free end via a feeler roller 68 on a guide track in the form of a supporting rail 69. The supporting rail 69 extending in a horizontal plane can be lifted and lowered, in the present case by means of a parallelogram of rods 70. The lifting part 65 and the pressure lever 66 are prestressed by a compression spring 71 in the direction to lift and clamp the cigarette block 34. The pressure lever 66 is pivotable in a clockwise direction, against the compression spring 71, as a result of the lifting of the supporting rail 69, whereby the lifting part 65 is lowered and the cigarette block 34 is freed from the clamping position. The supporting rail 69 is consequently lifted at each of the end positions of the block pocket 55.

Figure 6:
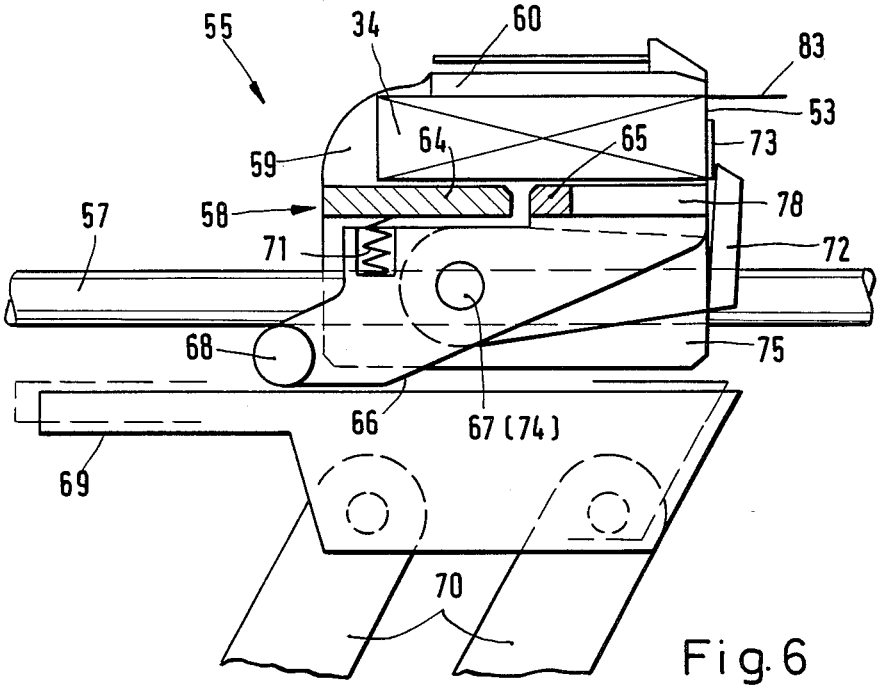
FIG. 6 shows, on an enlarged scale, a longitudinal section through a pocket for receiving a cigarette block.
Figure 7:
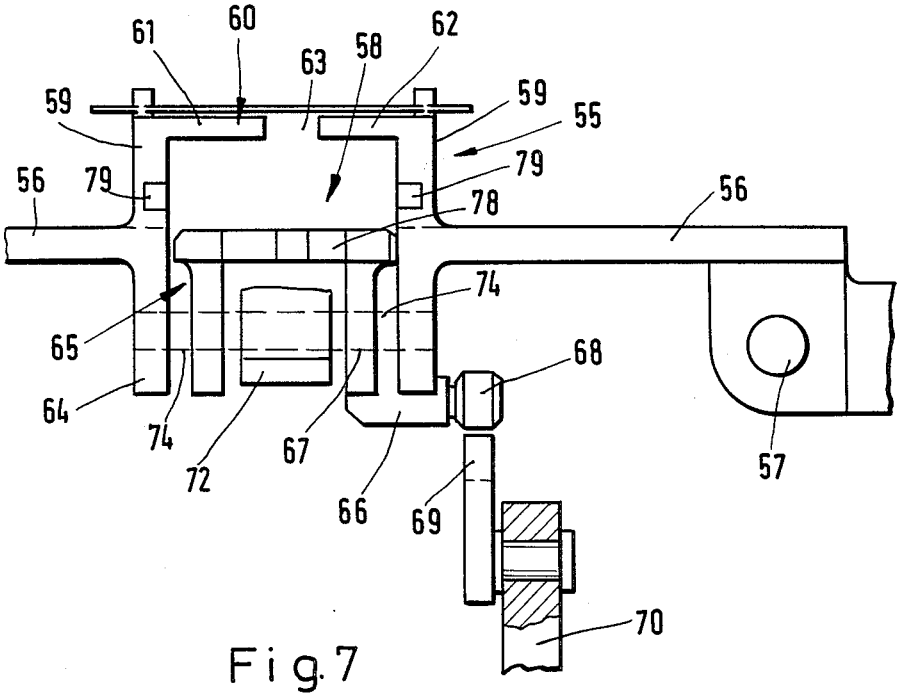
FIG. 7 shows, in a front view, the block pocket with a collar blank located above it.
Figure 8:
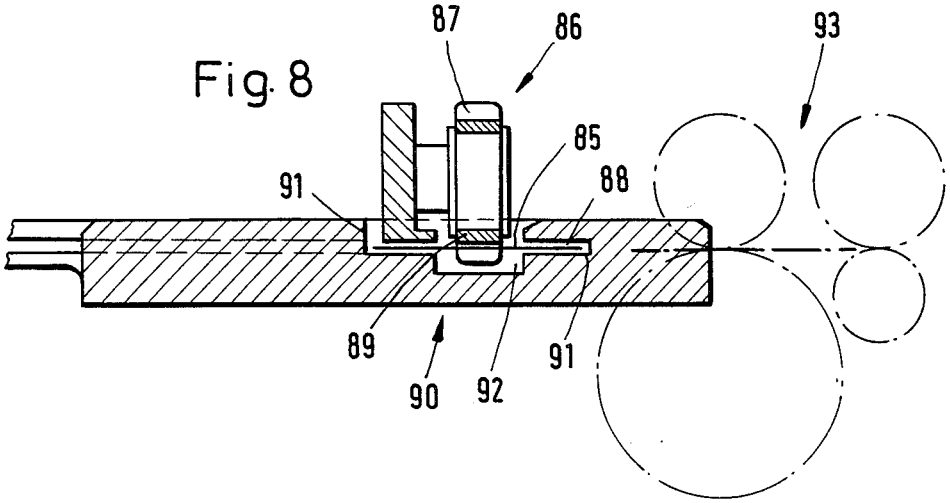
FIG. 8 shows, on an enlarged scale, a section VIII—VIII in FIG. 3.
Figure 9:
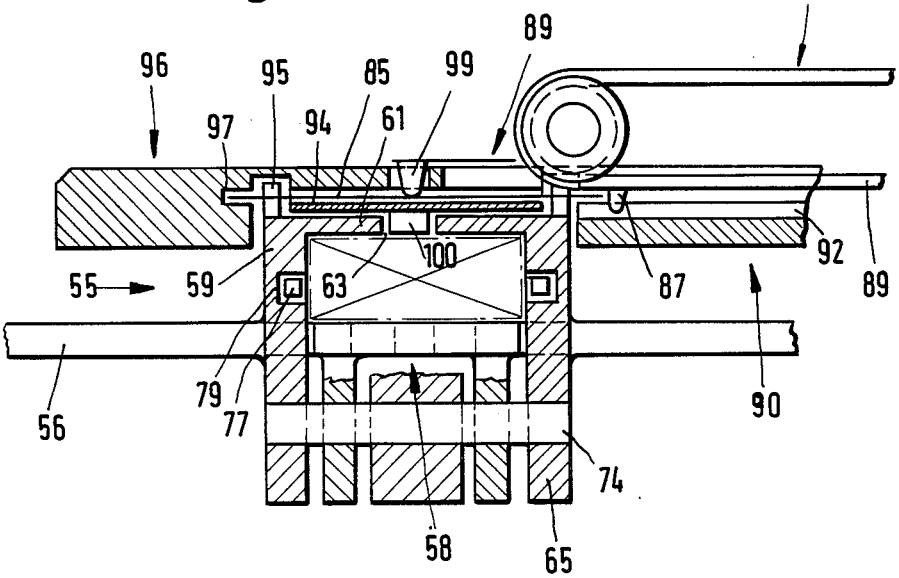
FIG. 9 shows a section IX—IX in FIG. 5.

A lower folding device 72 in the form of a pivotable lever is also located on the block pocket 55. After the cigarette block 34 has been introduced into the block pocket 55, this is pivoted in a folding direction, specifically approximately into the position according to FIG. 6. At the same time, a lower rearward-pointing end tab 73 of the tin foil blank 33 is folded into the plane of the rear end face 53. In the present case, the lower folding device 72 and the pressure lever 66 are mounted coaxially, namely arranged on a transversely directed axle 74 which is mounted in supporting legs 75 on the underside of the cross member 56.

Because of positive coupling, it is guaranteed that, in the initial position facing the pack track 54, the block pocket 55 is always retained in an exact relative position to ensure perfect introduction of the cigarette block 34 into the block pocket 55. For this purpose, bottom tongues 76 and side tongues 77 are located on the pack track 54. In the corresponding position of the block pocket 55, these projecting guide parts penetrate positively into recesses in it. For this purpose, the bottom 58 and the side walls 59 are provided with recesses 78 and 79 open to the rear for penetration of the bottom tongues 76 on the one hand and the side tongues 77 on the other hand. The side tongues 77 are designed as the continuation of lateral rails 80 of the pack track 54, whilst the bottom tongues 76 adjoin the plate-shaped pack track 54.

As in the apparatus according to U.S. Pat. No. 4,084,393, the cigarette block 34 is conveyed by the block pocket 55 into a region located at a distance in front of the folding turret 35. During the time when the block pocket 55 is guided back again into the initial position as a result of oppositely directed movement, there comes into action a pushing-out device 81 which is located above the path of movement of the block pocket 55 and which executes a complex up-and-down movement and a movement in the direction of transport of the cigarette block 34.

The pushing-out device 81 has a multiple function. The angle piece 82 serves as an upper folding device. During the downward movement of the pushing-out device 81 for grasping the cigarette block 34 on the rear end face 53, an upper rearward-pointing end tab 83 is folded over into the plane of the end face 53. Side tabs of the tin foil blank 33 have previously been folded into the plane of the end face 53, specifically by lateral folding devices which are not shown in any detail here, but correspond to the apparatus according to U.S. Pat. No. 4,084,393 and which are also located on the block pocket 55.

Figure 5:
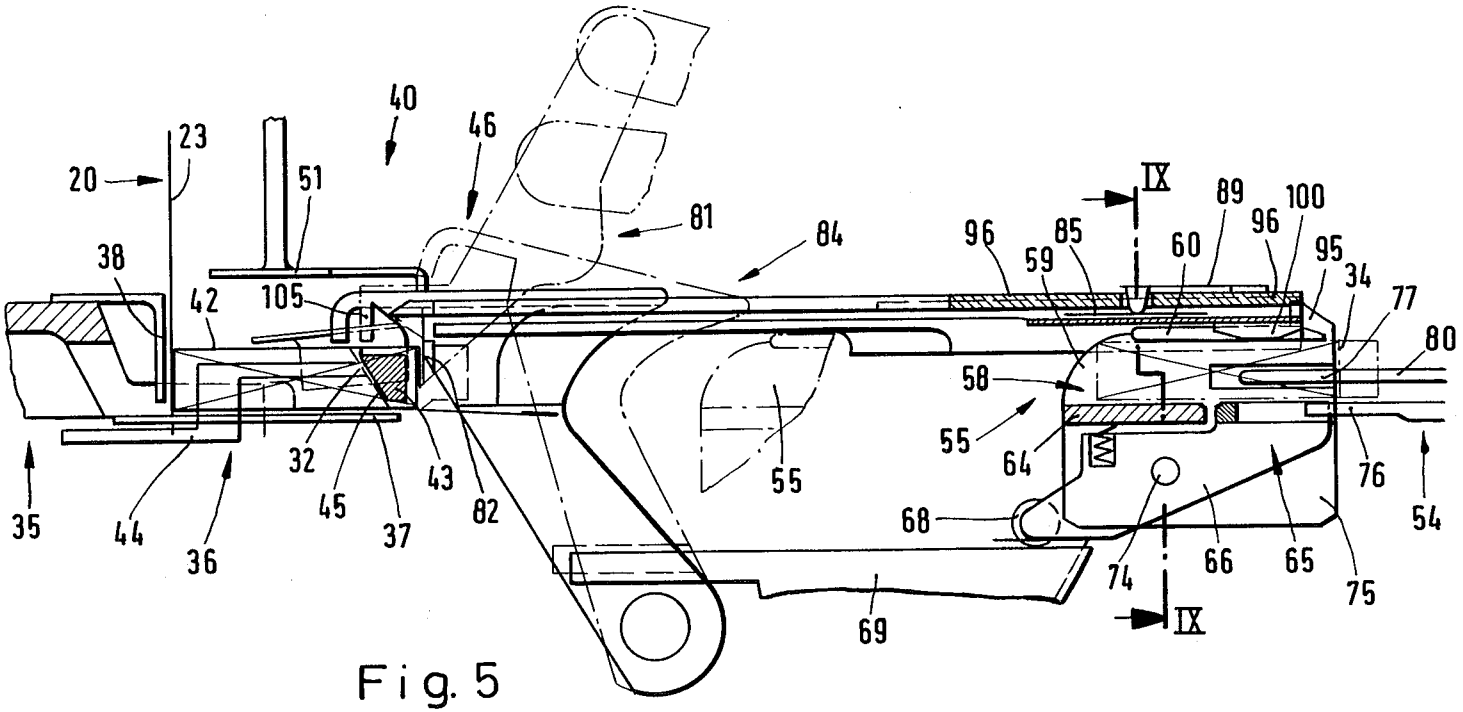
FIG. 5 shows a longitudinal section in the plane V—V of FIG. 4, with additional units.
Figure 11:
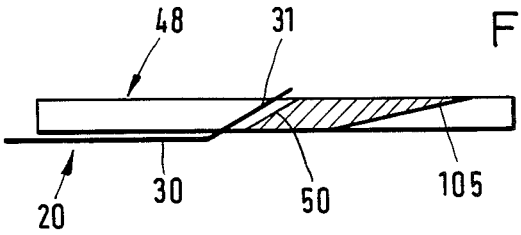
FIG. 11 shows, in a section XI—XI of FIG. 13, a detail of a folding member in the region of a feed station of the folding turret.
Figure 13:
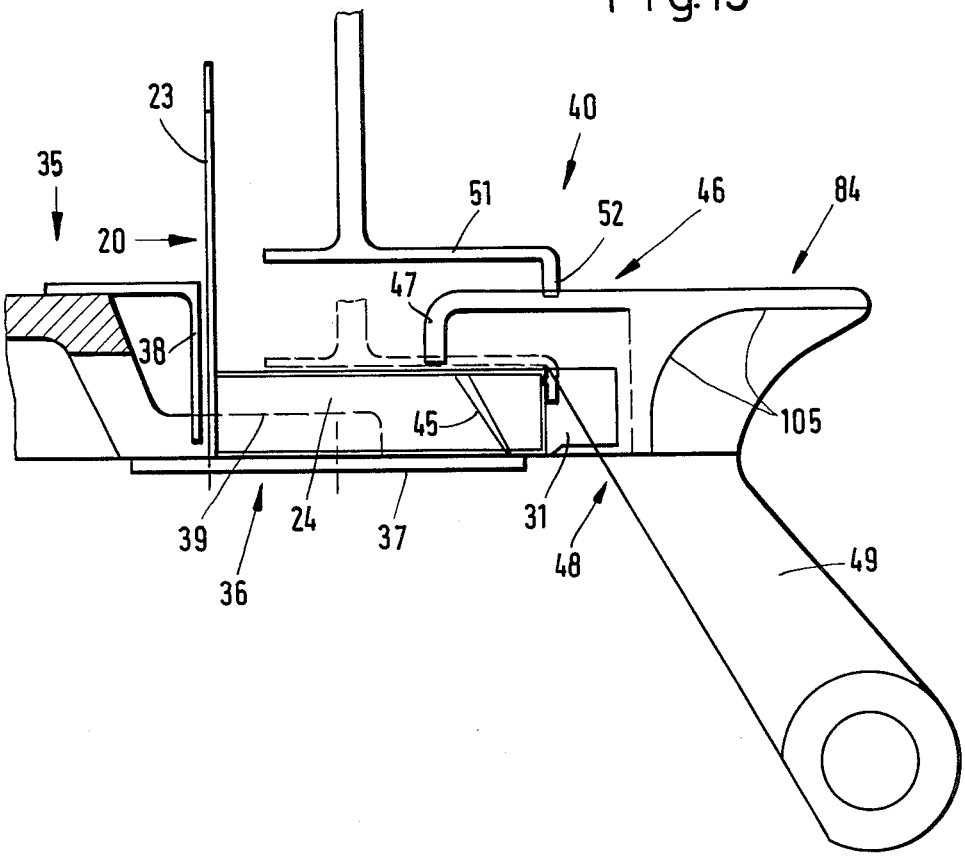
FIG. 13 shows, partially in a radial section, a representation of the detail according to FIG. 12, offset 90°.

The cigarette block 34, which, in the end position of the block pocket 55 facing the folding turret 35—approximately the position in FIG. 5 shown by dot-and-dash lines—is conveyed out of the block pocket 55 by the pushing-out device 81, is subsequently taken over by a transfer member which corresponds to the mouthpiece 116 of the above U.S. patent. The guide walls 48 already described are parts of this mouthpiece. The cigarette block 34 is conveyed by the pushing-out device 81 into the end position within the pack or within the blank 20. At the same time, the guide walls 48, or the mouthpiece 84 formed by these, execute a pivoting movement, and the holding-down devices 46 located on this mouthpiece 84 or on the guide walls 48 are moved into the working position. This pivoting movement also results in the lid corner tabs 31 passing into the funnel-shaped position shown in detail in FIG. 11. The retaining jaws 43 have already been brought into position previously. After the cigarette block 34 has been pushed in, the ram plate 51 is lowered into the adjusting position already described.

The further folding steps for the blank 20 can proceed in the way described in the above U.S. patent.

The packs of the "hinge-lid" type, mentioned primarily here, are predominantly equipped with a collar which is formed by a separate collar blank 85. This has to be fed to the cigarette block 34 and combined with it in a suitable way before completion of the pack, in such a way that the collar extends in the region of the front wall 23 and of the side walls formed by the side tabs 24 and 26.

For this purpose, the collar blanks 85 are fed transversely to the conveying direction of the cigarette block 34 and are thereafter transported parallel to and synchronously with the latter up to introduction into the pack or the blank 20. They are combined only within the pack pocket 36 of the folding turret 35.

The collar blanks 85 are introduced into the radial path of movement of the cigarette block 34 in the region of the rearward end position of the block pocket 55. The collar blanks 85 are fed in succession to this station by a collar conveyor 86. This is an especially lightweight or low-mass toothed belt made of plastic. Attached to its outside at a distance from one another are engaging noses 87 which each grasp a collar blank at the side, namely in the region of one of the collar side walls 88. The collars are consequently transported by the collar conveyor 86 in the relative position corresponding to further transport.

The arrangement in the region of the collar conveyor 86 is such that a lower side 89 ensures transport, the collar blanks 85 being conveyed, outside the region of the collar conveyor 86, by resting in or on a fixed transport track 90. This is designed essentially as a fixed plate with lateral guide slits 91 for the penetration of lateral regions of the collar blank 85 and with an approximately central depression 92 for the penetration of the collar conveyor 86. The collar blanks 85 are fed to the collar conveyor 86 transversely to its transport direction by means of conveyor rollers 93.

The collar blanks 85 are each deposited on the top side of the block pocket 55 by the collar conveyor 86 when the block pocket is in the initial position remote from the pack. A collar supporting plate 94 is arranged fixedly above the block pocket 55, namely at a slight distance above the top wall 60, for receiving the collar blank 85. This collar supporting plate extends between lateral engaging projections 95 on the top wall 60 of the block pocket 55 and in the rearward region of the latter. The above-mentioned engaging projections 95 grasp the collar blank 85 on the rear face during transport by the block pocket 55.

To allow the collar blank 85 to be introduced into the path of movement of the block pocket 55, the transport track 90 for the collar blank 85 is provided with a plate-shaped extension piece 96 which, on the side located opposite the collar conveyor 86, forms in relation to the block pocket 55 a stop for positioning the collar blank 85, specifically within a stop slit 97.

In order to fix the collar blank 85 exactly on the collar supporting plate 94 during this change in the direction of movement, a holding-down device 98 is located above the collar supporting plate 94. This consists of a spring plate with a pressure nose 99 resting resiliently against the top side of the collar blank 85. The holding-down device 98 is mounted fixedly. During feeding by the collar conveyor 86, the collar blank 85 is pushed under the pressure nose 99 and is drawn out of this retaining position during further conveyance, when the collar blank 85 is taken up by the engaging projections 95 of the block pocket 55. Located on the underside of the collar supporting plate 94 is an elongate cam 100 which, in the initial position, projects into the slit 63 formed between the legs 61 and 62 of the top wall 60 of the block pocket 55 and ends essentially flush with the underside of the top wall 60.

During further transport by the block pocket 55, the collar blank 85 is conveyed at a distance above the top wall 60 of the block pocket. For this purpose, a guide track 101 for the collar blank 85 adjoins the extension piece 96 or the stop slit 97 on both sides. It consists of elongate guide rails 102 and 103, between which is formed a guide slit 104 for the penetration of the lateral parts (collar side walls 88) of the collar blank 85.

The collar blank 85 is conveyed out of the guide track 101 only directly in the region of the pack pocket 36 of the folding turret 35, specifically being lowered onto the cigarette block 34 located under it. During this transfer stage, several processing operations take place. By means of the lateral guide walls 48 or specially shaped (arcuate) folding edges 105 located on these, the collar side walls 88 are folded over downwards because of the relative movement of the collar blank 85 in relation to the guide walls 48. This folding over of the collar side walls 88 takes place during a stage in which the collar blank 85 is still retained in the guide track 101. At the same time, the collar side walls 88 are folded round the lower guide rail 103 (FIG. 10). The guide walls 48 are thus moved in a pivoting motion and serve as a folding member. The collar blank 85 is consequently conveyed out of the guide track 101, with collar side walls 88 folded downwards, and lowered onto the cigarette block 34 within the blank 20.

At the same time, the collar blank 85 is adjusted in terms of its exact relative position in relation to the cigarette block 34, specifically as a result of the collar blank 85 resting against an adjusting piece 106 connected to the pushing-out device 81. During the transfer of the collar blank 85 to the cigarette block 34, this adjusting piece is located directly and at a slight distance above the latter. Because the cigarette block 34 is pushed out of the block pocket 55 by the pushing-out device 81, the collar blank 85 is also transported further, specifically by an adjusting piece 106 located at the front end of the pushing-out device 81. This also has the function of determining the exact relative position of the collar blank 85 in relation to the cigarette block 34 before the collar blank 85 is deposited on this. In so doing, the adjusting piece 106 comes to rest against an edge of the collar blank 85 within a collar recess 107, this edge pointing rearwards during transport. The distance between the adjusting piece 106 and the angled piece 82 as the actual pushing member for the cigarette block 34 therefore corresponds to the relative position between the collar blank 85 and the cigarette block 34.

The further folding steps for the pack proceed in a known way, especially in conformity with U.S. Pat. No. 4,084,393, according to the work cycle of the ram plate 51 already described.

We claim:

1. In an apparatus for filling hinged boxes formed from a foldable blank (20), said apparatus including a number of box pockets (36) each for maintaining an at least partially formed hinged box adapted to receive box contents at least partially wrapped in a wrapping blank to form a block (34) of the box contents prior to insertion into the box, the improvement comprising block pocket means (55) for carrying said block (34) from a conveying means (54) to a box pocket comprising:

a top wall (60), side walls (59), and a bottom (58);

said bottom (58) being comprised of a first fixed portion (64) and a second, movable portion (65) movable in a direction toward said top wall (60) to force a block therein against the top wall (60).

2. The apparatus according to claim 1, further including a pivotable pressure lever (66) pivotable about a bearing (67) of an axle (74), said movable portion of said bottom being connected to said pressure lever, and a vertically movable supporting rail (69) supporting a free end of said pressure lever.

3. The apparatus according to claim 2, further including roller means interposed between the free end of the pressure lever and said supporting rail for providing slidable engagement between said pressure lever and said supporting rail, and movement means (70) for imparting vertical movement to said pressure lever through said supporting rail.

4. The apparatus according to claim 3, further including compression spring means (71) for biasing said movable portion (65) of said bottom toward said top wall, said means for imparting vertical movement to said pressure lever causing said pressure lever to pivot about said bearing in a direction against the bias of the compression spring and away from said top wall as said supporting rail moves in an upward direction.

5. The apparatus according to claim 4, further including a folding device lever (72) pivotable about said axle (74) for folding a rearward facing portion of said wrapping blank into the plane of the rear end face (53) of said block.

6. The apparatus according to claim 5, further including horizontal support leg (56), upwardly extending vertical support legs (59) connected to said horizontal support legs and downwardly extending vertical support legs (64) connected to said horizontal support legs, said top wall being comprised of first and second top wall legs (61, 62) separated by a slot (63), said top wall legs being connected to said upwardly extending vertical support legs, said axle (74) being supported by said downwardly extending vertical support legs.

7. The apparatus according to claim 6, further including means for accurately aligning said block on its transition between said conveying means (54) and said block pocket means (55), aligning means comprising bottom tongues (76) and side tongues (77), said movable portion (65) of said bottom being provided with recesses (78) for receiving said bottom tongues, said upwardly extending vertical support legs (59) being provided with recesses (78) for receiving said side tongues.

8. Apparatus according to claim 1, further including a toothed conveyor belt (86) for transporting collar blanks (85) to said block pocket means, and means for intermittently driving said conveyor belt in a direction transverse to the direction of travel of said blocks (34).

9. Apparatus according to claim 8, wherein the collar conveyor (86) further includes means for grasping the side walls (88) of the collar blanks (85), and fixed transport track means (90) for supporting the collar blanks (85) resting on said fixed transport track (90) as said collar blanks are being transported.

10. Apparatus according to claim 9, wherein said fixed transport track means include a depression (92) and said collar conveyor further includes a lower side projection (89) extending into said depression, for conveying said collar blanks.

11. Apparatus according to claim 8, further including upwardly pointing engaging projections (95) for engaging the collar blanks (85) on top of the block pocket during transport by the block pocket.

12. Apparatus according to claim 11 further including a collar supporting plate (94) for temporarily supporting the collar blanks (85).

13. Apparatus according to claim 12, further including a pair of laterally extending guide tracks (101) each guide track (101) being comprised of two guide rails (102, 103) arranged above one another and between which is formed a guide slit (104) for receiving lateral regions of the collar blank (85), the distance between the two lateral guide tracks (101) corresponding approximately to the width of the collar blank (85), such that the collar side walls (88) project beyond the guide track (101).

14. Apparatus according to claim 1, further including a pushing-out device (81) for pushing the block (34) out of the block pocket (55) and into a box maintained in a box pocket (36), and a pivotable mouthpiece (84) for conveying a block (34) into a box in a box pocket (36).

15. Apparatus according to claim 14, wherein the pushing-out device (81) includes an angle piece (82) directed downwards, for folding a rearwardly directed end tab (83) of said wrapping blank into the plane of the end face of the block (34).

16. Apparatus according to claim 14, wherein the pushing-out device (81) further includes an adjusting piece (106) directed forwards, by means of which the collar blank (85) can be pushed out of the guide tracks (101) and deposited on the block (34) in a box, the angle piece (82) having guide faces, the distance between the guide faces of the angle piece (82), and the adjusting piece (106), on the corresponding to the exact relative position between the block (34) and the collar blank (85).

17. Apparatus according to claim 1, wherein the partially folded blank (20) for receiving the block (34) is located in a box pocket (36) of a folding turret (35), the relative position of the blank (20) within the pocket (36) being guaranteed by retaining members acting on the blank (20).

18. Apparatus according to claim 17, further including a holding-down device (46) for pressing side tabs (24) folded in an approximately vertical position and connected to a rear wall (25) of the blank (20) against a pocket bottom (37) of the box pocket (36).

19. Apparatus according to claim 18, wherein the holding-down device (46) is connected to the pivotable mouthpiece (84) and rests with downwardly directed pressure legs (47) on the top edge of the side tabs (24).

20. Apparatus according to claim 17, wherein the side tabs (24) are folded, within the pocket (36), into an oblique position by sloping pocket side walls (39) converging upwards.

21. Apparatus according to claim 17, further including means for causing the lid corner tabs (31) of the blank (20), folded into a vertical position, to be bent outwards to form a funnel-shaped entry orifice for the block (34), as a result of the lid corner tabs (31) resting against sloping supporting faces (50) of the guide walls (48) of the mouthpiece (84).

22. Apparatus according to claim 17, further including pivotable retaining jaws (43) for securing the blank (20) against being displaced in a radial direction within the pocket (36), said pivotable retaining jaws (43) being arranged laterally next to the pack pocket (36) and against a sloping supporting edge (45) of the side tabs (24) of the blank (20).

23. Apparatus according to claim 17, further including a ram plate (51) for pressing block (34) in a blank (20) against the rear wall (25).

24. Apparatus according to claim 23, wherein the ram plate (51) is provided with a stop (52) for positioning the block (34) in a radial direction within the blank (20).

* * * * *